United States Patent [19]

Hoshino

[11] Patent Number: 4,713,149

[45] Date of Patent: Dec. 15, 1987

[54] METHOD AND APPARATUS FOR ELECTROPLATING OBJECTS

[76] Inventor: Shigeo Hoshino, 1244-7, Mukogaoka, Miyamai-Ku, Kawasaki-shi, Kanagawa-ken 213, Japan

[21] Appl. No.: 933,167

[22] Filed: Nov. 21, 1986

[30] Foreign Application Priority Data

Nov. 26, 1985 [JP] Japan ..... 60-263888

[51] Int. Cl.[4] ..... C25D 5/22; C25D 17/00

[52] U.S. Cl. ..... 204/23; 204/217; 204/DIG. 10

[58] Field of Search ..... 204/23, 217, 224 R, 204/DIG.10

[56] References Cited

U.S. PATENT DOCUMENTS 3,706,650 12/1972 Eisner ..... 204/DIG. 10

*Primary Examiner*—T. M. Tufariello

[57] ABSTRACT

The invention relates to a method and apparatus for electroplating an object using a carbon fiber material as the anode and wherein during the plating operation relative motion is maintained between the object to be plated and the anode.

13 Claims, 4 Drawing Figures

FIG. 1
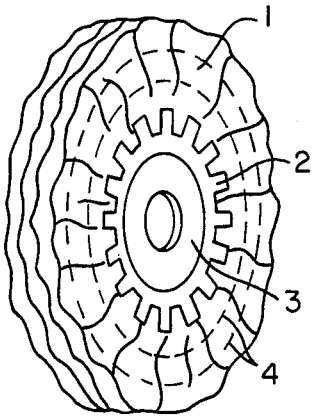
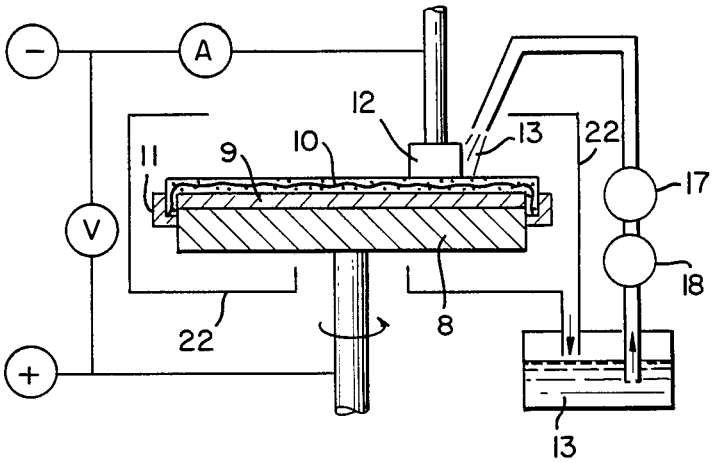
FIG. 3

METHOD AND APPARATUS FOR ELECTROPLATING OBJECTS

FIELD OF THE INVENTION

The invention relates to a new method and apparatus for electroplating objects using a carbon fiber material as the anode.

BACKGROUND OF THE INVENTION

In an ordinary electroplating, an object to be plated is placed as cathode in the plating bath and an anode is placed in the same bath with some distance from the cathode. The plating is accomplished by applying electricity for the external power source. In this method, the current distribution will vary depending on the shape of the object to be plated and the location of the anode. To make a homogeneous thickness of the metal plating, various techniques are used to make the current distribution homogeneous. To increase the plating speed, usually the current density is increased. Such an increase in the current density often produces adverse effect; uneven deposits and reduction of the current efficiency.

To avoid much adverse effect, relatively low rates or low current densities are being used in today's industrial process; for example 1 to 5 Amp./dm$^2$ for copper, nickel and zinc plating and 20 to 50 Amp./dm$^2$ for chromium plating which needs a high current and the plating rate is usually less than 1.0 $\mu$m/min. For high speed plating, usually the electrolyte solution is forced to flow at a high speed between the two electrodes. This method results in uneven current distribution. The high speed plating with high speed electrolyte circulation often require large size equipment which is an obvious disadvantage.

SUMMARY OF THE INVENTION

In the present invention, the plating is accomplished while supplying the plating solution to the contact area between the object to be plated and the carbon fiber at a continuous pressure of 0 to 1.0 kg/cm$^2$. In our common knowledge, we cannot expect any metal depostion or electrochemical reaction, since the carbon fiber is directly in front of the object to be plated. The present inventor has unexpectedly found from experiments that a good plating is accomplished with this method. Although the detailed mechanism of the plating process is not known, an extremely thin film of the plating solution would exist between the carbon fiber and the object and play an important role for the process since the plating process proceeded smoothly.

With the presently invented method, the inventor confirmed experimentally that a high speed plating at a high current density such as 100 to 500 Amp./dm$^2$ is accomplished. At a high current density plating, usually the current tends to concentrate to the edge or corner of the object and it results in an uneven thickness of the deposit. In the presently invented method, the electrolytic current flows directly from the carbon fiber to the object and only the contacted area is plated. Therefore the thickness of the deposits within the plated area (contact area) is more homogeneous compared to those obtained by the ordinary plating system.

In the method of this invention, relative movements are given between the object and the carbon fiber while supplying the plating solution to the contact area of the two. The carbon fiber acts as the anode and the object acts as the cathode in the electroplating operation.

Any carbon fiber materials such as carbon fiber cloth, non-woven material can be used as long as the material does not deteriorate too fast by the sliding friction. Any object which can be plated by a normal metal plating process, can be plated by this method. Any plating solution can be used for this process, but higher concentration of the metal salt is desired to increase the current efficiency at the high speed plating.

To accomplish a plating by the present method, movement should be given to the carbon fiber or the object, or to both. In any mode of the three movements, the plating solution should be supplied to the contact area between the carbon fiber and the object. Such a relative movement action is to effect the supply of the plating solution to the contact area. Therefore for the high speed plating, the relative movement action should be increased. When the contact pressure between the anode and the cathode is too high, plating efficiency decreases. Therefore maintaining pressure below 1 kg/cm$^2$ is preferable.

The presently invented process has the following benefits:

(1) A high speed plating is possible since much higher currents can be applied over the conventional process;

(2) Since the plating takes place mainly at the contact area between carbon fiber (anode) and the object (cathode), the current density is homogeneous and therefore the thickness of the plating is more even over the conventional process;

(3) Since the carbon fiber is flexible, a surface having various shape can be plated; and (4) By this method, a part of a large object can be easily plated at a high speed.

BRIEF DESCRIPTION OF THE DRAWINGS

FIG. 1 is an isometric view of a carbon fiber disc suitable for use in the practice of this invention.

FIG. 3 is a schematic of another embodiment of an apparatus suitable for practicing this invention.

FIG. 1 shows a buff-style disc composed of a carbon cloth 1 appropriately cut into shape and then multiple layers were sewn using a carbon fiber thread 4. The multiple layers were then sandwiched between metal rings 2 having radially extending tabs. Rings 2 were then sandwiched by smaller rings 3 having a central disposed opening. As shown in FIG. 2, a carbon fiber disc 5, made as described with reference to FIG. 1, acts as the anode and is placed within container 14. An object to the plated 6, is placed adjacent anode disc 5 and acts as the cathode for the electroplating process. Both anode disc 5 and cathode object 6 are connected across a voltage supple V with the positive terminal + connected to the anode disc 5 and the negative terminal connected to the cathode object 6. Plating solution 7 is pumped from a reservoir by pump 16 and fed through a filter 15 and then fed to the interface of anode disc 5 and cathode object 6. With the voltage supplied from source V, a current A is fed through anode disc 5, cathode object 6 and plating solution 7. During the plating process, anode disc 5 is rotated so that relative motion is maintained between the carbon fiber anode and the object to be plated.

FIG. 3 is another schematic embodiment of an apparatus for use in the invention comprising a container 22 having disposed within said container a rotatable carbon fiber anode disc 10. The anode disc 10 is prepared by gluing an insulating plastic disc 9 onto a rotatable metal disc 8 and then a carbon fiber disc 10, larger in size than the plastic disc 9, is positioned over the plastic disc 9 and secured on the metal disc 8 using a metal clamp ring 11. Disposed adjacent the rotatable carbon fiber disc 10 (anode) is an object (cathode) 12 to be plated. As described in reference to FIG. 1, the object (cathode) 12 is coupled to the negative terminal − of voltage source V while the rotatable anode 10 is coupled to the positive terminal + of voltage source V. Plating solution 13 is pumped from a reservoir by pump 18 and fed through a filter 17 and then fed to the interface of anode 10 and object 12. With the voltage supplied from source V, a current A is fed through anode 10, object cathode 12 and plating solution 13. During the plating process, anode 10 is rotated so that relative motion is maintained between the carbon fiber anode and the object to be plated.

FIG. 4 illustrates another isometric view of a carbon fiber anode for use in this invention. Specifically, a carbon fiber cloth 19 is applied around a metal cylinder 21 and secured thereto using a suitable glue such as an epoxy glue 20. This type of carbon fiber anode is suitable for plating large metal parts.

EXAMPLES

Example 1

Figure 2:
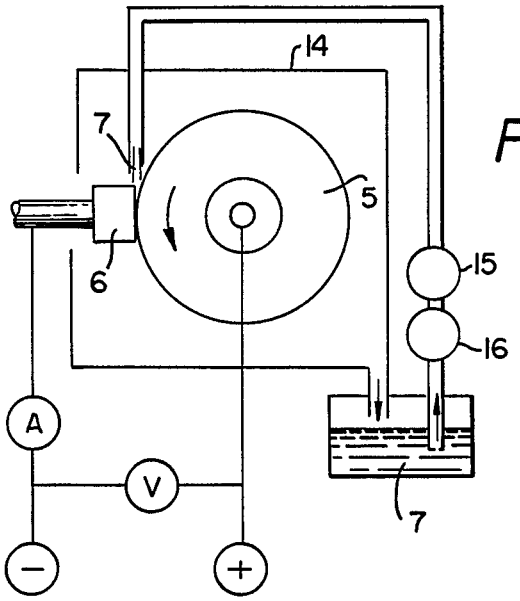
FIG. 2 is a schematic of an apparatus suitable for practicing this invention and employing the carbon fiber disc of FIG. 1.

A buff-style disc of the type shown in FIG. 1 was prepared using a multiple layers of woven carbon fiber cloth (0.4 mm thick). The carbon fiber had a tensile strength of 200 kgf/mm$^2$ and modulas of 15000 kgf/mm$^2$. The carbon cloth was cut into shape and then the multiple layers were sewn with a carbon fiber thread. The body of the multiple carbon layer disc was sandwiched with metal rings as described in FIG. 1. The anode disc had an outside diameter of 200 mm and the inside diameter of the ring was 75 mm and the thickness was 20 mm. Using the apparatus as shown schematically in FIG. 2, the anode disc was rotated at 1000 rpm and a current of 200 Amp./dm$^2$ was passed between the object to be plated and the anode disc while maintaining a pressure of 0.5 kg/cm$^2$ between the anode disc and the object. The plating solution was supplied at a rate of 50 liter per minute to the contact area. The plating solution contained nickel sulfate 400 g/l, boric acid 30 g/l, and the temperature was maintained at 60° C. The plating speed was 20 μm/min with a current efficiency of 50%.

Example 2

Using an apparatus as shown schematically in FIG. 3 a plastic disc was glued on a metal disc for insulation. A carbon fiber disc having a size larger than the metal disc was fixed on the plastic disc. The edge of the carbon fiber disc was clamped with a metal side ring. The object to be plated was plated by passing current of 500 Amp./dm$^2$ between the carbon fiber disc anode and the object cathode, while rotating the disc at 300 rpm. The plating solution was the same as that of example 1 and operated at 60° C. The contact pressure between the carbon fiber anode and the object was 0.1 kg/cm$^2$. The deposit surface was smooth and slightly shiny. The deposit rate was 55 μm/min. with 55% current efficiency.

Example 3

Figure 4:
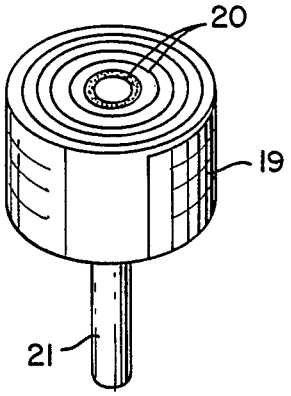
FIG. 4 is an isometric view of another embodiment of a carbon fiber member suitable for use in the practice of this invention.

A carbon fiber anode was prepared as shown in FIG. 4. Specifically, a carbon fiber cloth was made of carbon fiber having a tensile strength of 120 kgf/mm$^2$ and modulas of 4800 kgf/mm$^2$. The carbon cloth was applied around a metal cylinder and secured with an epoxy glue to the cylinder as basically shown in FIG. 4. This carbon fiber anode was fixed and rotated with an electric drill for the purpose of operating the presently invented process. While supplying a plating solution, the surface of a large metal object was successfully plated. This type of operation is found to be suitable for plating part of large metal parts.

What is claimed

1. An apparatus for electroplating objects comprising an anode, an object to be plated serving as a cathode, said anode comprising a carbon fiber material and said anode placed adjacent said object, means for supplying a plating solution to the interface of said object and said anode through the carbon fiber material of said anode, means for supplying an electric current between said anode and said cathode; and means for providing relative motion between said anode and said object so that during the plating operation movement between the object to be plated and the carbon fiber material of the anode can be maintained.

2. The apparatus of claim 2 wherein the carbon fiber materials of said anode is maintained in pressure contact with said object at a pressure below 1 kg/cm$^2$.

3. The apparatus of claim 1 wherein the carbon fiber material of said anode is maintained in pressure contact with said object at a pressure of between 0 and 1.0 kg/cm$^2$.

4. The apparatus of claim 1 wherein said anode is moveable and said object is fixed.

5. The apparatus of claim 1 wherein said anode is fixed and said object is moveable.

6. The apparatus of claim 1 wherein said anode is moveable and said object is (fixed) moveable.

7. The apparatus of claim 1 wherein said anode is a disc and said disc is rotatable.

8. A method for electroplating objects comprising the steps:

(a) preparing a plating solution;

(b) preparing an anode with a carbon fiber material and positioning said anode adjacent an object to be plated, said object serving as a cathode;

(c) causing relative motion between said object and the carbon fiber material of said anode while supplying said plating solution in step (a) to the interface of said object and said anode and also while supplying an electric current between said anode and said object so that during the plating operation movement between said object and said anode is maintained.

9. The method of claim 8 wherein in step (b) the carbon fiber material of said anode is maintained in pressure contact with said object at a pressure below 1 kg/cm$^2$.

10. The method of claim 8 wherein in step (b) the carbon fiber material of said anode is maintained in pressure contact with said object at a pressure of between 0 and 1.0 (k/cm$^2$) kg/cm$^2$.

11. The method of claim 8 wherein in step (c) said anode is a disc and is rotated to provide relative movement between the carbon fiber material and said object to be plated.

12. The method of claim 8 wherein in step (c) said object is moveable so as to provide relative movement between the carbon fiber material and said anode.

13. The method of claim 8 wherein in step (c) both said anode and said object are moveable so as to provide relative movement between the carbon fiber material of said anode and said object.

* * * * *